United States Patent [19]

Kaneko et al.

[11] 4,114,536

[45] Sep. 19, 1978

[54] METHOD OF AND APPARATUS FOR TRANSFER PRINTING A TONER IMAGE

[75] Inventors: Yutaka Kaneko; Tsutomu Ishida, both of Tokyo, Japan

[73] Assignee: Ricoh Co., Ltd., Japan

[21] Appl. No.: 828,220

[22] Filed: Aug. 26, 1977

[30] Foreign Application Priority Data

| | | | |
|---|---|---|---|
| Aug. 26, 1976 | [JP] | Japan | 51-101983 |
| Feb. 7, 1977 | [JP] | Japan | 52-11594 |
| Mar. 23, 1977 | [JP] | Japan | 52-31853 |
| Mar. 29, 1977 | [JP] | Japan | 52-35047 |

[51] Int. Cl.[2] ..... G03G 13/14

[52] U.S. Cl. ..... 101/426; 101/DIG. 13; 96/1.4; 355/3 BE; 355/3 TE; 355/3 TR; 346/153

[58] Field of Search ..... 101/426, DIG. 13, 1 R; 96/1.4; 355/3 BE, 3 DR, 3 SH, 3 TE, 3 TR, 10; 346/152–156

[56] References Cited

U.S. PATENT DOCUMENTS

| | | | |
|---|---|---|---|
| 3,697,160 | 10/1972 | Clark | 355/3 BE |
| 3,778,841 | 12/1973 | Gundlach et al. | 355/3 BE X |
| 3,850,519 | 11/1974 | Weikel, Jr. | 355/3 TR |
| 3,947,113 | 3/1976 | Buchan et al. | 96/1.4 |
| 3,961,951 | 6/1976 | Mayer et al. | 96/1.4 |
| 4,000,942 | 1/1977 | Ito et al. | 355/3 TR |

FOREIGN PATENT DOCUMENTS

| | | | |
|---|---|---|---|
| 2,627,464 | 12/1976 | Fed. Rep. of Germany | 96/1.4 |

OTHER PUBLICATIONS

"Transfer Charge Maintaining System" Borostyan, Xe Discl. Journal, vol. 1, No. 6, Jun. 1976, p. 83.

*Primary Examiner*—E. H. Eickholt
*Attorney, Agent, or Firm*—McGlew and Tuttle

[57] ABSTRACT

A method and apparatus for transfer printing a toner image from an image forming surface to the surface of a recording sheet by means of a transfer printing member electrically charged to have the same polarity as the electrostatic latent image on the image forming surface. The recording sheet is initially engaged with the image forming surface before engaging the transfer printing member, and then is fed to the transfer printing station while pressed against the image forming surface with a low pressure by the transfer printing member to effect a toner image transfer printing. The recording sheet is subsequently separated from the image forming surface while being electrostatically supported by the transfer printing member.

6 Claims, 21 Drawing Figures

1
2
3
4
5
6
7
8
9
10
11
12
13
14
15
16
S 1
t
t'
S
9

1
8
9
10
11
12
13
14
15
16
17
20
21
22
23
24
S

METHOD OF AND APPARATUS FOR TRANSFER PRINTING A TONER IMAGE

FIELD AND BACKGROUND OF THE INVENTION

This invention relates to an improved method of and apparatus for transfer printing, from an image forming surface to the surface of a recording sheet, a toner image obtained by developing an electrostatic latent image with a powder developing agent.

There are various types of transfer printing methods known in the art. In one widely practised method, corona transfer printing is effected under the influence of corona discharge. This method has a disadvantage in that the deterioration of a photosensitive body is speeded up and the service life thereof is reduced. An additional disadvantage is that means for feeding recording sheets must be provided separately. In another method known in the art, transfer printing is effected by using a metallic roller on which a bias voltage is impressed. When this method is used, a discharge occurring between the photosensitive body and very small projecting portions of the metallic roller on which a bias voltage is impressed tends to damage the photosensitive body. Moreover, owing to the fact that the width over which the photosensitive body and the metallic roller are brought into contact with each other is small, satisfactory results are not obtained in effecting transfer printing. Furthermore, since the recording sheet is abruptly separated from the photosensitive body after transfer printing of a toner image is effected, an electric force acts between the toner particles on the recording sheet and the electric charge remaining on the photosensitive body, with the result that there is the danger of the toner image on the recording sheet being disturbed. In still another method, an electrically conductive rubber roller, on which a bias voltage is impressed, is used for performing transfer printing. This method also has the disadvantage of a discharge occurring between the photosensitive body and very small projecting portions of the electrically conducting rubber roller on which a bias voltage is impressed.

In order to obviate the aforementioned disadvantages of various transfer printing methods, a transfer printing method utilizing a transfer printing belt is known.

SUMMARY OF THE INVENTION

This invention has as its object the provision of an improved method of and apparatus for transfer printing a toner image utilizing a transfer printing belt.

BRIEF DESCRIPTION OF THE DRAWINGS

The features and advantages of the transfer printing method according to the invention and an apparatus adapted to carry the method of the invention into practice will be described, in comparison with a conventional transfer printing apparatus, by referring to the accompanying drawings, in which.

DESCRIPTION OF THE PREFERRED EMBODIMENTS

Figure 1:
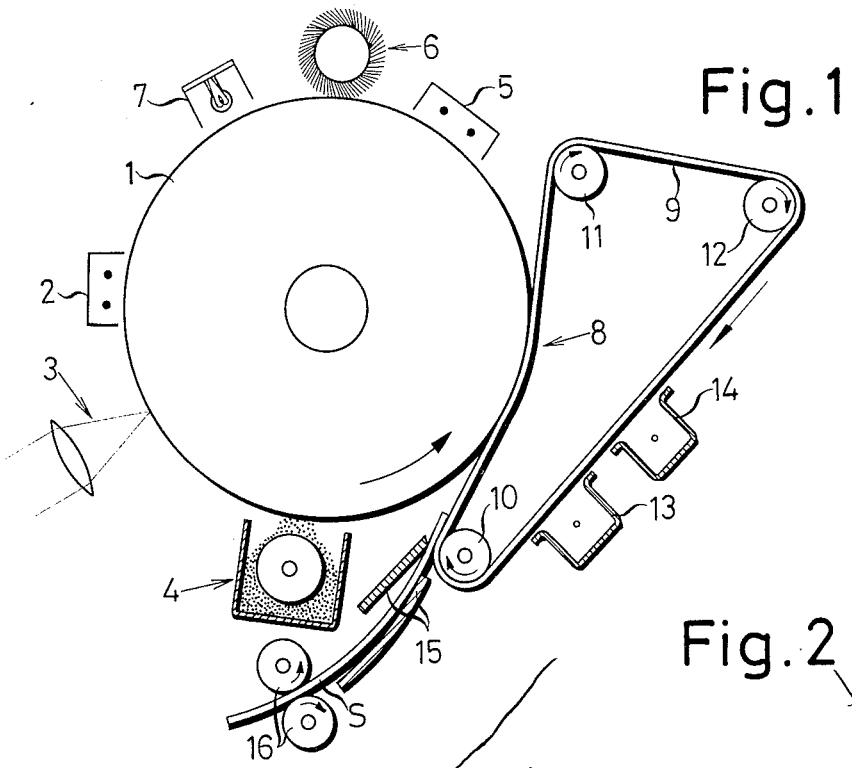
FIG. 1 is a front view of the essential portions of a typical transfer printing apparatus of the prior art utilizing a toner image transfer printing process relying on a transfer printing belt.

FIG. 1 shows a conventional transfer printing apparatus using a transfer printing belt in which a photosensitive drum 1 has located along its outer periphery a charging station 2, an exposing station 3, a developing station 4, a transfer printing station 8, an electric charge removing station 5, a cleaning station 6 and a quenching lamp 7 which are arranged in the indicated order in the direction of rotation of the drum 1. In the transfer printing station 8, a transfer printing belt 9 trained about pulleys 10, 11 and 12 is brought into contact with the outer periphery of the photosensitive drum 1. The transfer printing belt 9 is in the form of an endless belt having on its outer surface a dielectric layer and formed on its inner surface with an electrically conducting layer which is grounded. The transfer printing belt 9 is maintained with its outer surface in area contact with the outer periphery of the photosensitive drum 1 at the transfer printing station 8.

The transfer printing belt 9, which is driven to travel by a drive system, not shown, in the direction of an arrow shown in FIG. 1, moves at the same rate of movement as that of a toner image formed on the photosensitive drum and which moves as the photosensitive drum 1 rotates.

A corona charger 13 charges the surface of the upper outer surface of the transfer printing belt moving toward the transfer printing station 8 in such a manner that the outer surface thereof is charged oppositely, in polarity, to a toner image. A corona charge remover 14 removes electric charge from the portions of the outer surface of the transfer printing belt 9 which have contributed to transfer printing and causes the outer surface of the transfer printing belt 9 to be charged, by the corona charger 13, so as to have a constant surface potential at all times when the transfer printing belt 9 moves toward the transfer printing station 8.

When transfer printing is performed, a recording sheet S is fed and the transfer printing belt 9 is moved and charged in synchronism with the movement of a toner image. The recording sheet S is fed by a pair of feed rollers 16, 16 and guided by a guide 15 in such a manner that a leading end portion of the recording sheet S is brought into contact with the transfer printing belt 9 at the position of the pulley 10. Since the outer surface of the transfer printing belt 9 is charged by the corona charger 13, the recording sheet S electrostatically adheres to the surface of the transfer printing belt 9 and is delivered to the transfer printing station 8 as the transfer printing belt 9 travels. At this time, a toner image formed on the outer periphery of the photosensitive drum 1 enters the transfer printing station 8, and the recording sheet S is superposed on the toner image. At the transfer printing station 8, the toner particles forming the toner image are attracted by the electric charge carried by the outer surface of the transfer printing belt 9 which is greater than the attracting force of the charge of the electrostatic latent image, so that the toner image is transfer-printed on the surface of the recording sheet S.

After the toner image has been transfer-printed, the recording sheet S is stripped off the outer periphery of the photosensitive drum 1, and delivered to a fixing station while being electrostatically supported by the transfer printing belt 9.

In the aforesaid transfer printing process, the surface of the transfer printing belt 9 is brought into contact with the toner image forming surface of the photosensitive drum 1 in area contact, so that the recording sheet S is brought into contact with the toner image for a period of time sufficiently long to enable the toner image to be transferred to the recording sheet S. Thus transfer printing of the toner image is effected with a high degree of efficiency. Moreover, since the transfer printing belt 9 contacts the image forming surface of the photosensitive drum 1 very softly, there is no danger of the image forming surface being mechanically damaged.

However, the aforesaid transfer printing process has the disadvantage of producing a disturbance in the transfer-printed image on the recording sheet.

This invention provides an improved toner image transfer printing method which produces no disturbance of a transfer printed image, and an apparatus adapted to carry the improved method into practice.

Figure 2:
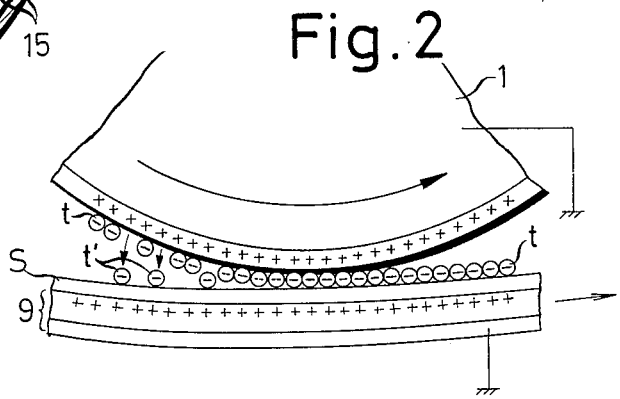
FIG. 2 is a view in explanation of the manner in which a disturbed image is produced when the transfer printing apparatus shown in FIG. 1 is used.

The invention will now be described with reference to the accompanying drawings. We have conducted experiments to determine the cause of a disturbance of a transfer-printed image. We have ascertained, as the result of the experiments, that the relative positions of the recording sheet S and the image forming surface of the photosensitive drum 1 immediately before the recording sheet S is introduced into the transfer printing station 8 are responsible for the disturbance of the transfer-printed image. This finding will be described with reference to FIG. 2.

Heretofore, in the toner image transfer printing process using the transfer printing belt 9, it has been customary that the recording sheet S electrostatically adheres to the transfer printing belt 9 prior to being introduced into the transfer printing station 8 so that the sheet S is delivered by the transfer printing belt 9 to the transfer printing station 8. In such case, since the surface of the transfer printing belt 9 is charged at a higher potential, some toner particles $t'$ of toner particles $t$ forming a toner image on the image forming surface of the photosensitive drum 1 are attracted by the electric charge carried on the surface of the transfer printing belt 9 and transferred at random to the surface of the recording sheet S immediately before the sheet S is superposed on the toner image on the drum 1, thereby causing a disturbance in the transfer-printed image on the recording sheet S.

Figure 3:
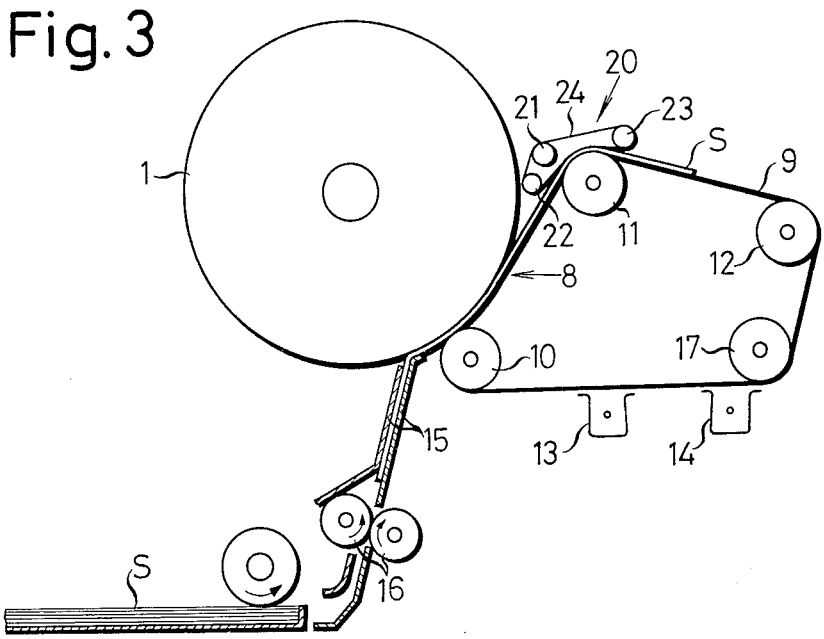
FIG. 3 is a front view of the essential portions of the transfer printing apparatus comprising one embodiment of the invention.

FIG. 3 shows one embodiment of the toner image transfer printing apparatus according to the invention. In the interest of clarity, like reference characters designate similar parts in FIG. 1 et seq. As shown, the transfer printing belt 9 is trained about pulleys 10, 11, 12 and 17 and consists of an electrically conducting endless belt base of a volume resistivity of less than $10^{10}\Omega$cm, and a dielectric layer of a volume resistivity of over $10^{13}\Omega$cm formed as of polytetrafluoroethylene (Teflon), polyethylene, and polyesters (polyethylene telephthalate and the like) and formed on the endless belt base. The drive roller 12 and photosensitive drum 1 are driven for rotation by the same power source through a chain and sprocket arrangement, with the drive roller 12 driving the transfer printing belt 9 at a rate which is the same as the peripheral velocity of the photosensitive drum 1. The recording sheet S is delivered by the pair of sheet feed rollers 16 and guide 15 to the transfer printing station 8. At this time, the recording sheet S is directed by the guide 15 toward the surface of the image carrying portion of the photosensitive drum 1. Then, the leading end portion of the recording sheet S is brought into contact with the image forming surface of the drum 1 and electrostatically adheres to the surface due to the electric charge carried on the surface. As the photosensitive drum 1 rotates, the recording sheet S moves together with the image forming surface and is held between the photosensitive drum 1 and the transfer printing belt 9 which is in contact with the drum 1 at a low pressure. Thus the recording sheet S is pressed at low pressure against the surface of the image forming surface of the photosensitive drum 1. The low pressure is in the range between 10 and 5,000 gr/cm$^2$ or preferably in the range between 500 and 2,000 gr/cm$^2$.

Figure 4:
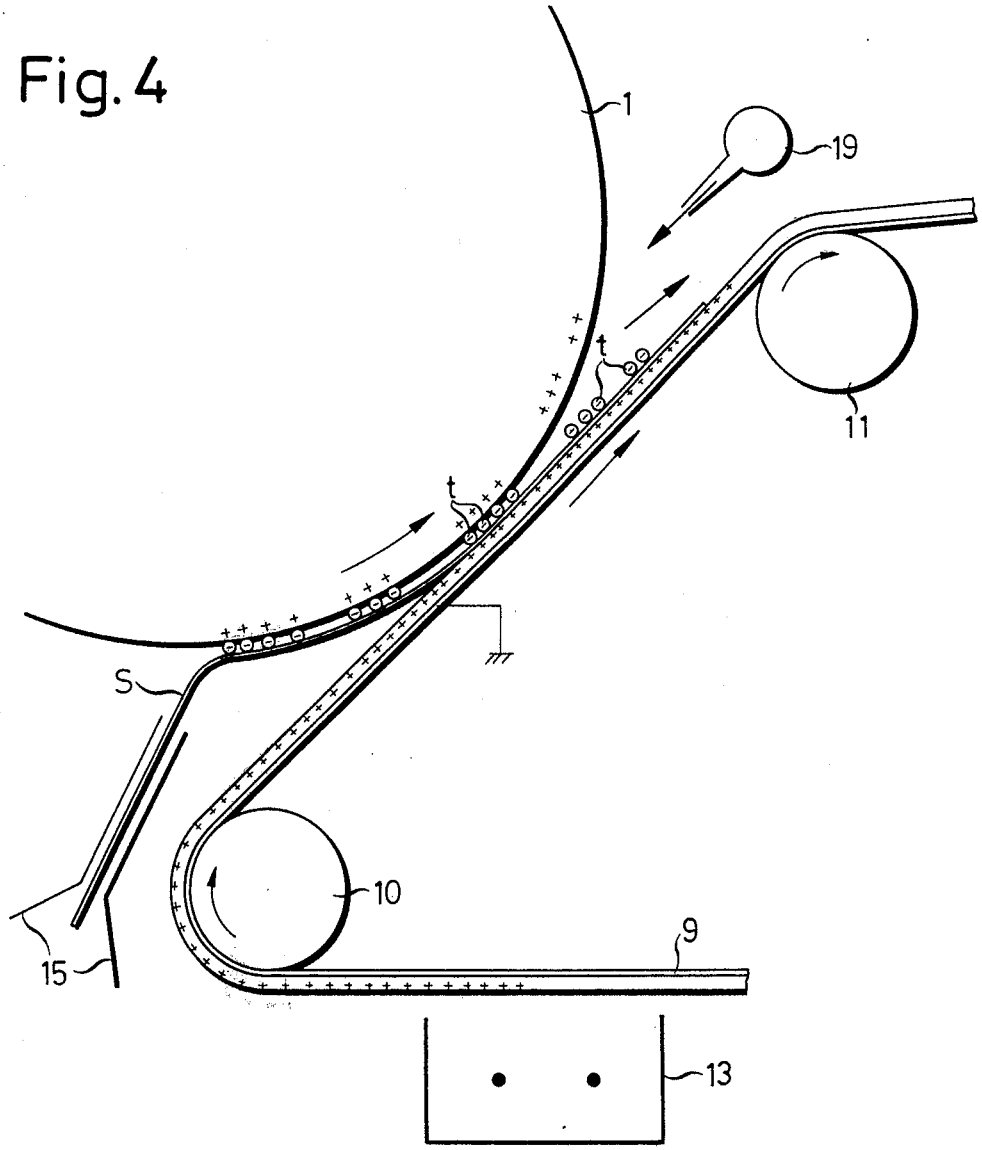
FIG. 4 is a view in explanation of the function of the present invention.

By this arrangement, the movement of the toner particles $t$ is interfered with, as can be seen in FIG. 4, by the recording sheet S, no matter how the toner particles $t$ forming the toner image are subjected to the influence of the electric force of the electric charge carried on the transfer printing belt 9. Thus the aforesaid disturbance of the transfer-printed image on the recording sheet S can be avoided. In the transfer printing station 8, the toner image can be transfer-printed on the recording sheet as has hitherto been performed.

The recording sheet S on which the toner image has been transfer-printed electrostatically adheres to the surface of the transfer printing belt 9 by virtue of the difference in the electric forces, and is released from the surface of the photosensitive drum 1 together with the transfer printing belt 9 for conveyance to the fixing station. At this time, if necessary, an air jet nozzle 19 is advantageously arranged as shown in the upper right portion of FIG. 4 to aid in separating the recording sheet S from the photosensitive drum 1. The jet stream of air ejected through the nozzle 19 is blown between the surface of the photosensitive drum 1 and the leading end portion of the recording sheet S to help in stripping the recording sheet S off the photosensitive drum 1.

If the recording sheet S separates itself from the transfer printing belt 9 while being conveyed by the latter after transfer printing of the toner image has been effected as aforesaid, the recording sheet S will be compressed and deformed while being conveyed, thereby causing what is referred to as sheet jam. Stripping of the recording sheet S from the transfer printing belt 9 tends to occur at portions of the transfer printing belt 9 which are curved or in positions at which the transfer printing belt 9 is in contact with the pulleys about which the belt 9 is trained. When the direction of movement of the transfer printing belt 9 is altered greatly at the curved portions of the belt 9, the force of resilience of the recording sheet S overcomes the electrostatic force by which the recording sheet S adheres to the transfer printing belt 9, and the recording sheet S is stripped at its leading end portion off the transfer printing belt 9. In actual practice, such stripping occurs most often at the portion of the belt 9 trained about the pulley 11. A stripping preventing mechanism 20 shown in FIG. 3 is accordingly located at a position in which the transfer printing belt 9 comes into contact with pulley 11.

The stripping preventing mechanism 20 comprises rotatable pulleys 21, 22 and 23, and a belt 24 trained about these pulleys. The belt 24 is brought into contact with the recording sheet S between the pulleys 22 and 23, and moves as the recording sheet S travels so as to press the recording sheet S against the transfer printing sheet at the curved portion of the belt, so as to prevent the stripping of the recording sheet off the transfer printing belt 9. The belt 24 is brought into contact with only a marginal portion of the recording sheet parallel to the direction of movement thereof so as not to disturb the transfer-printed toner image on the recording sheet S. In order to ensure that stripping of the recording sheet from the transfer printing belt is prevented, the stripping preventing mechanism of the aforesaid construction may be provided on either end of pulley 11 in the longitudinal or axial direction thereof.

Figure 5:
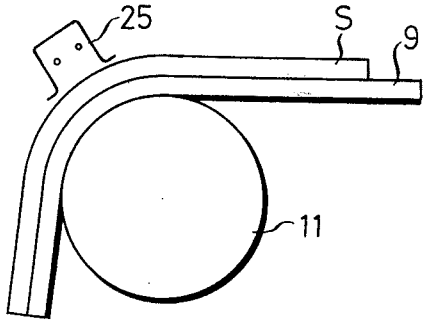
FIG. 5 is a view showing a modification of the stripping preventing mechanism.

The stripping preventing mechanism may be constructed such that, in place of the aforesaid construction, an air current of an intensity which does not disturb the toner image on the surface of the recording sheet may be blown against the surface of the recording sheet S. FIG. 5 shows a modification of the stripping preventing mechanism which is in the form of a corona discharger 25 which is operative to impart to the recording sheet S an electric charge of the opposite polarity to the electric charge on the transfer printing belt 9, so as to increase the electric adhering force of the recording sheet S to the transfer printing belt 9 to thereby prevent stripping of the former from the latter.

Figure 6:
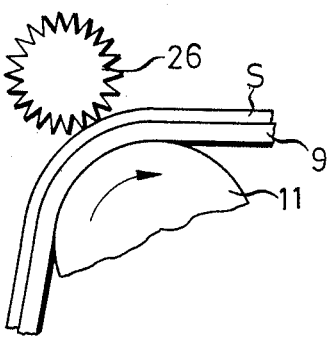
FIG. 6 is a view showing still another modification of the stripping preventing mechanism.

FIG. 6 shows still another modification of the stripping preventing mechanism which comprises at leaset one knurled member 26 rotatably positioned at a curved portion of the transfer printing belt 9 so as to urge the recording sheet S to press lightly against the transfer printing belt 9. The knurled member 26 being maintained in contact with the recording sheet S only in point contact, there is no danger of the toner image on the recording sheet being disturbed.

Figure 7:
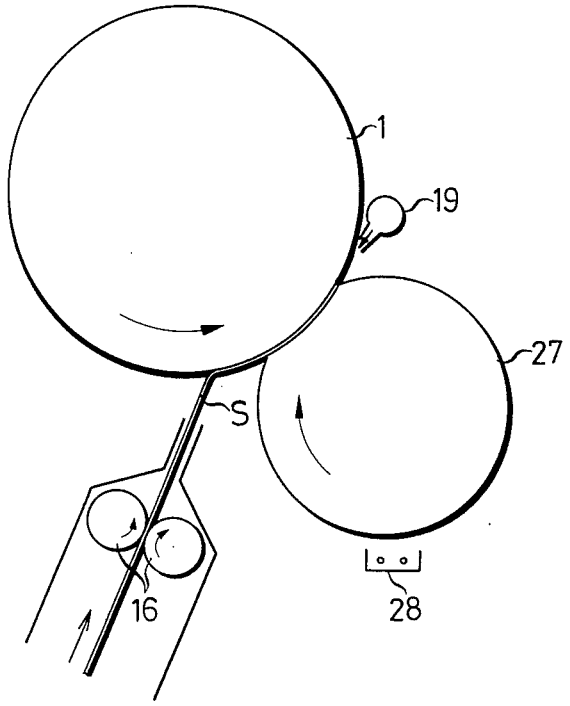
FIG. 7 is a view showing a modification of the transfer printing member.

FIG. 7 shows a transfer printing member which is in the form of a transfer printing roller 27, in place of the transfer printing belt, and which is adapted to rotate in synchronism with the photosensitive drum 1. The transfer printing roller 27 is brought into contact with the surface of the image carrying portion of the photosensitive drum 1 with a light force. To this end, the transfer printing roller 27 is advantageously formed of a soft material, such as chloroprene rubber or polyurethane rubber treated in a manner to have an electrically conducting property which has a volume resistivity of less than $10^{10}\Omega$cm. The transfer printing roller 27 has an outer surface which is a dielectric layer as is the case with the transfer printing belt 9 and which is charged by a charging device 28. The recording sheet S is stripped off the photosensitive drum 1, after a toner image has been transfer-printed thereon, by using the air current nozzle 19 as auxiliary means.

Figure 8:
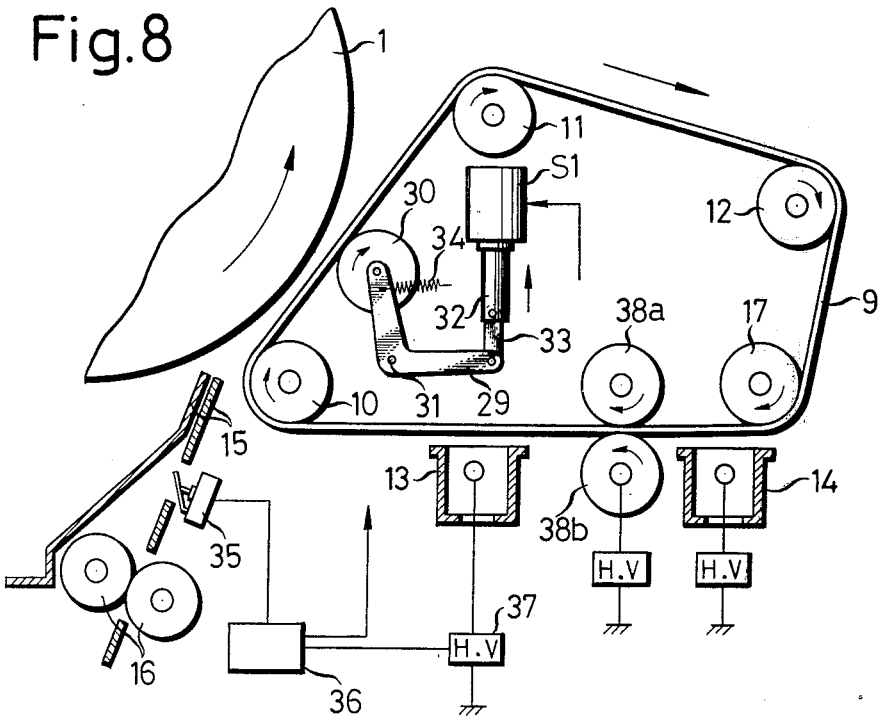
FIG. 8 is a view in explanation of the transfer printing apparatus comprising another embodiment of the invention, with the apparatus being inoperative.
Figure 9:
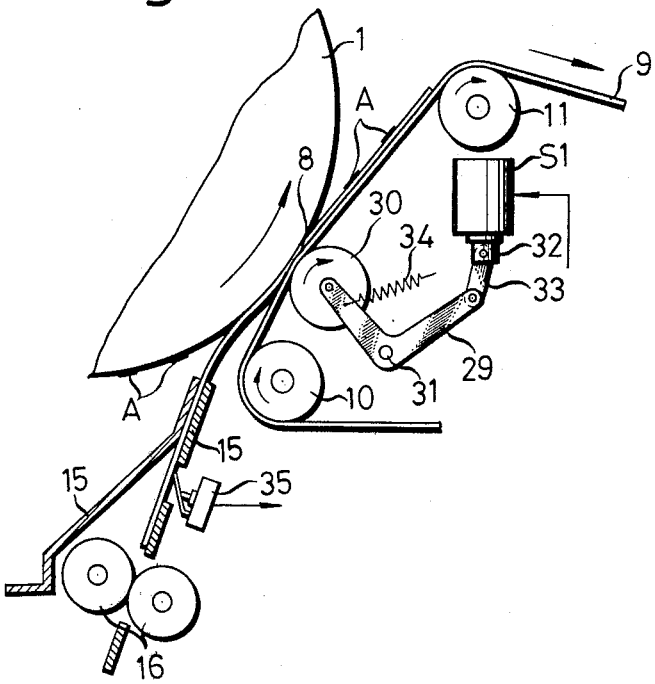
FIG. 9 is a view in explanation of the apparatus of FIG. 8 performing a transfer printing operation.

In the embodiment of the invention shown in FIG. 8 and FIG. 9, the transfer printing belt 9 may comprise, for example, a dielectric layer made of silicone rubber and an electrically conducting support member made of chloroprene rubber treated in a manner to have an electrically conducting property, and has the property of stretching as a whole. FIG. 8 shows the transfer printing apparatus in its inoperative position. As shown, the transfer printing belt 9 is trained about the pulleys 10, 11, 12 and 17 and spaced apart from the image forming surface of the photosensitive drum 1. A rubber roller 30 rotatably supported at one end of an L-shaped arm 29 is located adjacent the transfer printing belt 9 on a side thereof opposite the photosensitive drum 1. The L-shaped arm 29 is pivotally supported at its central portion through a pin 31 by a machine frame, and secured by a pin at the other end thereof to a plunger 32 of a solenoid $S_1$ through an intermediate member 33. A tension spring 34 is mounted between a portion of the L-shaped arm 29 near the end thereof at which the rubber roller 30 is supported and a portion of the machine frame, so as to bias the L-shaped arm 29 to move clockwise in pivotal movement about the pin 31. This clockwise movement of the L-shaped arm 29 normally moves the rubber roller 30 away from the transfer printing belt 9. In FIG. 8, the plunger 32 is shown as projecting from the solenoid $S_1$, and the L-shaped arm 29 is at the limit of its clockwise pivotal movement about the pin 31, so that the rubber roller 30 is maintained in light engagement with the inner surface of the transfer printing belt 9. The rubber roller 30 is preferably made of a relatively soft rubber material having a rubber hardness of up to about 50. This is because of the fact that, if the rubber roller 30 is soft, it is suitably deformed when it is brought into pressing engagement with the transfer printing belt 9 in effecting transfer printing as subsequently to be described, so that the transfer printing belt 9 can be supported in its maximum area by the roller 30 and transfer printing of the image on a recording sheet can be effected satisfactorily. A detector 35 for detecting the recording sheet S being fed is mounted between the guide plates 15, 15 for guiding the recording sheet S to the transfer printing station. A detection signal generated by the detector 35 is transmitted to a controller 36 which receives the signal and energizes the solenoid $S_1$ and gives a command to the charger 13 to turn on a high voltage power source 37 thereof. The numerals **38*a* and 38*b* designate a pair of cleaning rollers for removing the dirt adhered to the transfer printing belt 9**.

Referring to FIG. 8 and FIG. 9, if a toner image A on the image carrying portion of the photosensitive drum 1 moves to the transfer printing station 8, then the recording sheet S is also fed by the pair of rollers 16, 16 toward the transfer printing station 8. Upon the leading end of the recording sheet S being detected by the detector 35, the detector 35 generates a signal which turns on the high voltage power source 37 through the controller 36, so as to thereby cause the charger 13 to charge the transfer printing belt 9 oppositely to the toner particles.

The solenoid $S_1$ is energized only when the recording sheet S moves through the transfer printing station 8, so that the rubber roller 30 will cause the transfer printing belt 9 and recording sheet S to press against the image forming surface of the photosensitive drum 1, as shown in FIG. 9. According to the embodiment described above, the transfer printing belt 9 is pressed against the image forming surface of the photosensitive drum 1, with the recording sheet S being interposed therebetween, in synchronism with the feeding of the recording sheet only when transfer printing is effected, so that direct contact of the transfer printing belt 9 with the image forming surface of the photosensitive drum 1 can be avoided. This arrangement minimizes the danger of toner particles adhering to the image forming surface of the photosensitive drum 1, and eliminated damage to the photosensitive drum 1 which would otherwise occur due to unnecessary frictional contact with the transfer printing belt 9. Moreover, no soiling of the outer surface of the recording sheet S occurs when transfer printing is effected, and mounting and removing of the photosensitive drum as well as dismantling thereof can be readily performed. Since the latent image on the image carrying portion is not damaged, it is possible to advantageously produce a plurality of copies from the single latent image by repeatedly performing developing and transfer printing.

Figure 10:
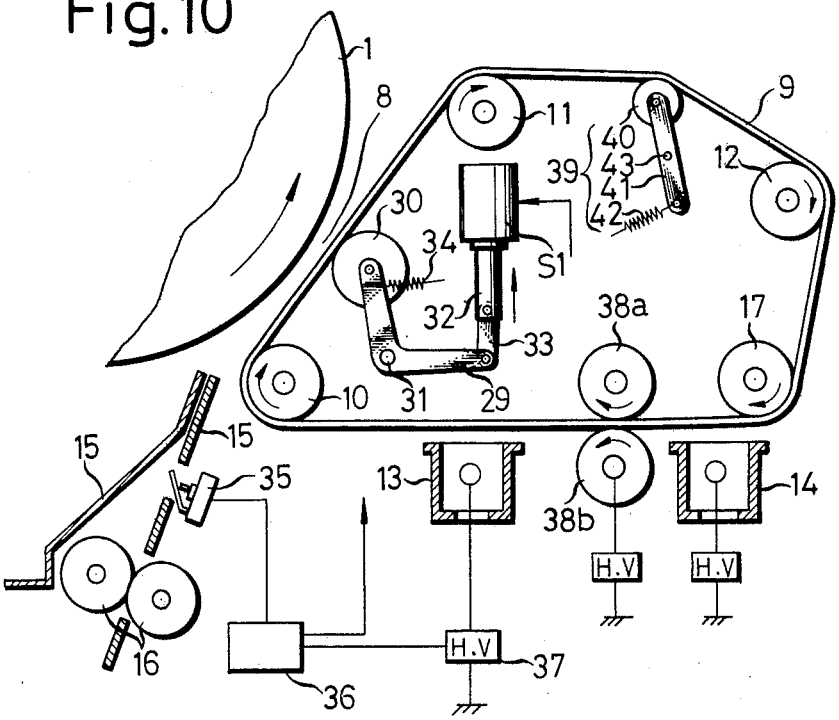
FIG. 10 and FIG. 11 are views in explanation of the transfer printing apparatus comprising still another embodiment of the invention, shown in inoperative and operative positions, respectively.
Figure 11:
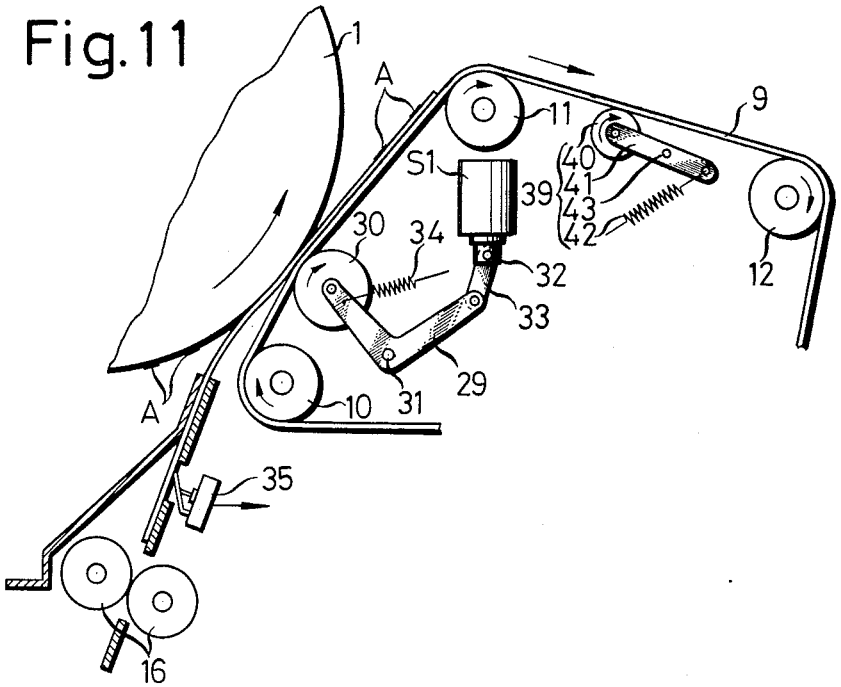
Figure 12:
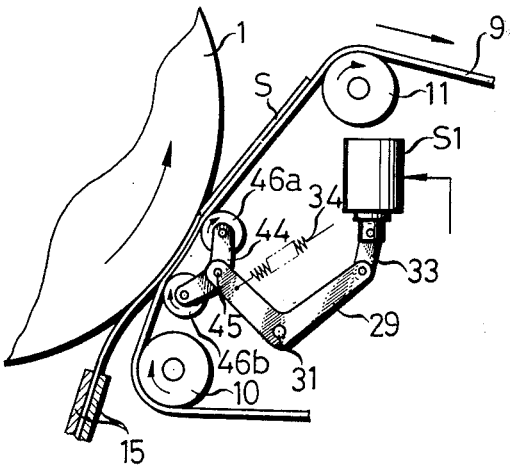
FIG. 12 is a view showing a modification of the apparatus shown in FIG. 8 and FIG. 11.

In the embodiment shown in FIG. 10 and FIG. 11, the transfer printing belt 9 used has the property of not substantially stretching. The transfer printing belt 9 used in this embodiment consists of an electrically conducting supporting member of a thin sheet of stainless steel, and a dielectric layer formed of polytetrafluoroethylene (Teflon), for example. The transfer printing belt 9 of this embodiment has a greater length than the transfer printing belt 9 used in the embodiment shown in FIG. 8 and FIG. 9. When no transfer printing is effected as shown in FIG. 10, excess length of the transfer printing belt 9 is absorbed by a belt projecting device 39 mounted between the pulleys 11 and 12. At the transfer printing station 8, the transfer printing belt 9 extends linearly between the pulleys 10 and 11, so that it is spaced apart from the photosensitive drum 1.

The belt projecting device 39 comprises a roller 40, an arm 41 and a spring 42. The arm 41 rotatably supports a roller 40 at one end thereof, and is supported at its central portion through a pin 43 by the machine frame. The other end of the arm 41 is pulled by the tension spring 42, so that the arm 41 is normally urged to pivot clockwise about the pin 43 to bring the roller 40 into pressing engagement with the transfer printing belt 9. Thus the transfer printing belt 9 is kept taut at all times.

FIG. 11 shows the transfer printing apparatus in its operative position. Upon a recording sheet S being fed to the transfer printing station, the solenoid $S_1$ is energized to cause the rubber roller 30 to push the transfer printing belt 9 toward the image carrying portion of the photosensitive drum 1, and at the same time the arm 41 pivots counterclockwise about the pin 43. Thus the excess length of the transfer printing belt 9 which has been absorbed by the pressing roller 40 is released and the transfer printing belt 9 can be moved toward the photosensitive drum 1.

In place of the rubber roller 30 supported at one end of the L-shaped arm 29, a pivotal arm 44 may be pivotally supported at its central portion through a pin 45 by the L-shaped arm 29, and rubber rollers **46*a* and 46*b* may be rotatably mounted on opposite ends of the pivotal arm 44. By this arrangement, the area at which the recording sheet S is brought into pressing contact with the image carrying portion of the photosensitive drum 1** can be increased when transfer printing is performed and transfer printing can be effected satisfactorily.

In the transfer printing process described above, the transfer printing belt 9 should be charged such that the electric charge carried thereon is over 1,000 volts at surface potential. Since the surface potential corresponds to a force for attracting a toner image on the photosensitive drum, the copy obtained has an image of a darker color if the surface potential is sufficiently high so as not to damage the photosensitive drum and sufficiently high so as not to destroy the latent image on the photosensitive drum when a plurality of copies are to be produced from the single latent image. However, the darkness of the color of the copy produced will be irregular unless the transfer printing belt is uniformly charged across its width and length. Ununiformity of electric charge is mainly caused by an unbalance of the distance between the transfer printing belt and a wire or wires of the charger. The transfer printing belt is trained over a plurality of pulleys and driven to move endlessly. During its movement, the transfer printing belt becomes somewhat wobbly due to the material of the belt, size thereof and tension and vibration thereof which arise from the power for driving the belt. If the transfer printing belt becomes wobbly when juxtaposed against the charger 13, the distance between the charging wires and the transfer printing belt becomes ununiform, with the result that the surface potential of the transfer printing belt becomes ununiform.

To solve this problem, in accordance with the invention it is proposed to mount the charger 13 in a position in which the transfer printing belt 19 juxtaposed thereagainst travels with a minimum of wobbling motion.

Figure 13:
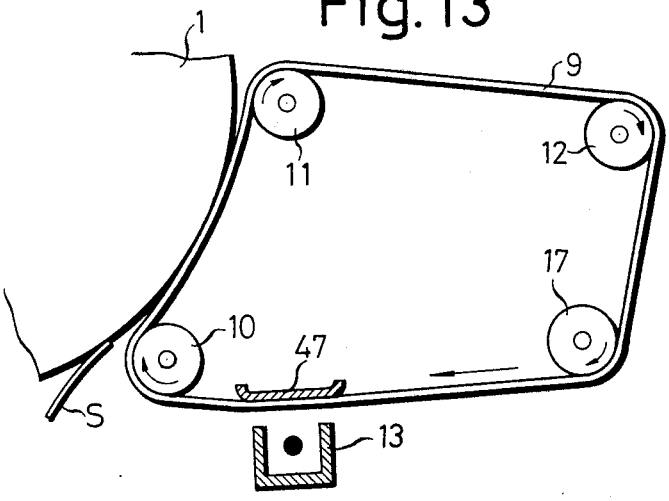
FIG. 13 is a view showing the arrangement of the charger in a position where wobbling of the transfer printing belt does not occur.

FIG. 13 shows an example in which an auxiliary tensioning member 47 is used. The auxiliary tensioning member 47 is arranged between the pulleys 10 and 17 in a manner to press the transfer printing belt 9 downwardly, so as to prevent loosening or wobbling of the transfer printing belt 9 between the two pulleys 10 and 17. The charger 13 is located in a position in which it is immediately below the auxiliary member 47 and juxtaposed against the outer surface of the transfer printing belt 9.

Figure 14:
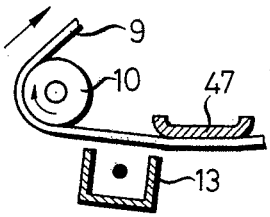
FIG. 14 through FIG. 21 are views showing modifications of the arrangement of the charger shown in FIG. 13.

FIG. 14 shows an example in which the position of the charger 13 is displaced slightly from the position which is immediately below the auxiliary member 47.

Figure 15:
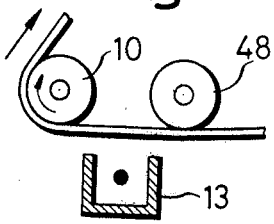
Figure 16:
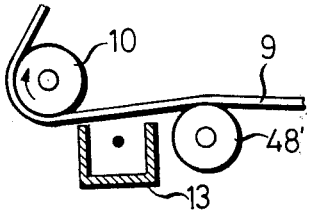

FIG. 15 shows a modification of the embodiment shown in FIG. 14 in which the auxiliary member is in the form of a roller 48. FIG. 16 shows a further modification in which an auxiliary member 48' is located on the same side as the charger 13 relative to the transfer printing belt 9 and positioned in close proximity to the charger 13.

Figure 17:
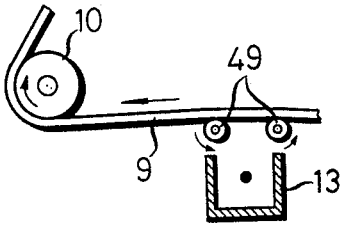
Figure 18:
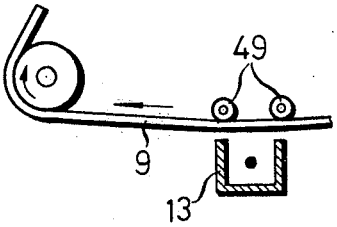

In FIG. 17, two rotary rollers 49, 49 acting as auxiliary members are arranged between the transfer printing belt 9 and the charger 13. In FIG. 18, the rotary rollers 49, 49 are located immediately above the charger 13 and on a surface of the transfer printing belt 9 opposite to the surface thereof which is juxtaposed against the charger 13.

Figure 19:
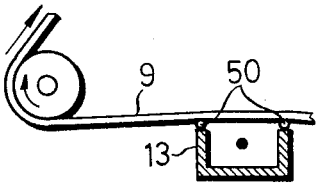

In the embodiment shown in FIG. 19, auxiliary members 50 are mounted at opposite end portions of an electrically conducting casing of the charger 13 or the forward end portions are treated to become electrically insulating.

Figure 20:
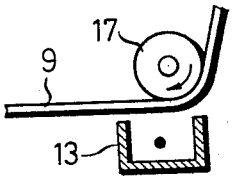

FIG. 20 shows an embodiment in which no auxiliary member is used and the charger 13 is arranged immediately below the pulley 17. The transfer printing belt 9 is least wobbly at a portion thereof which is in contact with one of the pulleys over which the belt 9 is trained. By charging the transfer printing belt 9 in this position, it is possible to obtain uniform charging of the belt 9.

Figure 21:
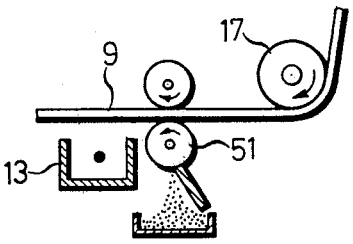

FIG. 21 also shows an embodiment in which no auxiliary member is used and the charger 13 is arranged in the vicinity of a belt cleaning device 51. The belt cleaning device 51 comprises two rollers which hold the belt 9 therebetween, so that a portion of the belt 9 near the device 51 is least wobbly. Thus it is possible to uniformly charging the transfer printing belt 9 by using this position.

From the foregoing description, it will be appreciated that no displacement of the image occurs because a transfer printing sheet is brought into intimate contact with the image forming surface of the photosensitive drum beforehand, and that no crushing of the toner particles occurs because a transfer printing sheet is brought into contact with the image forming surface with a low force by a transfer printing member. Since static electricity is utilized for effecting transfer printing, no abnormal discharge occurs between the transfer printing member and the photosensitive drum if the potential of the electric charge of the dielectric layer of the transfer printing member is kept below a certain level. Moreover, since the transfer printing sheet emerges from the transfer printing station while being maintained in intimate contact with the transfer printing member, the transfer printing sheet is separated slowly from the photosensitive drum, so that changes in the electric field between the electric charge carried by the photosensitive drum and the toner particles on the transfer printing sheet occur relatively slowly. This is conducive to prevention of the disturbance of the transfer-printed image by the latent image and production of a copied image of high quality.

What we claim is:

1. A toner image transfer printing method comprising the steps of feeding a recording sheet into intimate contact with a moving image-forming surface, carrying a toner particle image formed by developing an electrostatic latent image with a powder developer, for movement of the recording sheet with the image-forming surface; thereafter progressively engaging the outer surface of that portion of the recording sheet engaged with the moving image-forming surface with a transfer printing member having, on its recording sheet engaging surface, a dielectric layer electrically charged to the same polarity as the electrostatic latent image; utilizing the transfer printing member to progressively press the recording sheet against the moving image-forming surface with a low pressure; and progressively disengaging the recording sheet, together with the transfer printing member, from the image-forming surface with the toner particles on the image-forming surface being attracted to the recording sheet by the electrostatic force of the charged dielectric layer of the transfer printing member.

2. An apparatus for transfer printing a toner image on a recording sheet from a moving image-forming surface carrying a toner particle image formed by developing an electrostatic latent image with a powder developer, said apparatus comprising, in combination, a guide device operable to guide the recording sheet progressively into intimate contact with said moving image-forming surface; and an endless transfer printing belt including a dielectric layer, formed on its outer surface and adapted to come into contact with the image-forming surface, and an electrically conducting layer, formed on its inner surface; said endless transfer printing belt being operable to progressively engage the outer surface of that portion of the recording sheet engaged with the moving image-forming surface to press the recording sheet, with a low force, against the moving image-forming surface to maintain the recording sheet in intimate contact with the moving image-forming surface; a charger operable to charge the dielectric layer of said endless transfer printing belt to the same polarity as the electrostatic latent image; and driving means operable to move said endless transfer printing belt in synchronism with the movement of said image-carrying surface.

3. An apparatus as set forth in claim 2, further comprising stripping preventing means located at a curved portion of the endless transfer printing belt for preventing stripping of the recording sheet from said endless transfer printing belt at said curved portion after transfer printing is effected.

4. An apparatus as set forth in claim 2, further comprising support means supporting said transfer printing belt is spaced apart from said image forming surface, and pressing means operable to move a portion of the transfer printing belt toward the image forming surface when transfer printing is performed so as to bring the recording sheet into pressing engagement with the image forming surface.

5. An apparatus as set forth in claim 2, wherein said charger is arranged at a position in which wobbling motion of said transfer printing belt is minimized.

6. An apparatus as set forth in claim 5, further comprising an auxiliary belt tensioning member arranged in the vicinity of said charger.

* * * * *